US011434934B2

(12) United States Patent
Klassen et al.

(10) Patent No.: US 11,434,934 B2
(45) Date of Patent: Sep. 6, 2022

(54) SYSTEM AND METHOD FOR END POSITION DAMPING

(71) Applicant: Festo SE & Co. KG, Esslingen (DE)

(72) Inventors: Daniel Klassen, Esslingen (DE); Gerhard Gommel, Notzingen (DE)

(73) Assignee: Festo SE & Co. KG, Esslingen (DE)

( * ) Notice: Subject to any disclaimer, the term of this patent is extended or adjusted under 35 U.S.C. 154(b) by 0 days.

(21) Appl. No.: 17/230,171

(22) Filed: Apr. 14, 2021

(65) Prior Publication Data

US 2021/0324879 A1 Oct. 21, 2021

(30) Foreign Application Priority Data

Apr. 15, 2020 (DE) ..... 102020204737.5

(51) Int. Cl.
*F15B 11/048* (2006.01)

(52) U.S. Cl.
CPC ..... *F15B 11/048* (2013.01); *F15B 2211/853* (2013.01); *F15B 2211/8855* (2013.01)

(58) Field of Classification Search
CPC ..... F15B 11/048; F15B 2211/853
See application file for complete search history.

(56) References Cited

U.S. PATENT DOCUMENTS 4,628,499 A * 12/1986 Hammett ..... F15B 11/048 318/599
5,347,914 A * 9/1994 Kinoshita ..... F15B 15/082 92/88
6,085,632 A * 7/2000 Stoll ..... F15B 11/048 91/361

FOREIGN PATENT DOCUMENTS

DE 102016206821 A1 10/2017
DE 102018209856 A1 12/2019

* cited by examiner

*Primary Examiner* — Abiy Teka
*Assistant Examiner* — Michael Quandt
(74) *Attorney, Agent, or Firm* — Hoffmann & Baron LLP

(57) ABSTRACT

A system including a pneumatic actuator with an actuator member and a compressed air supply device which is configured to apply compressed air to the pneumatic actuator in order to set the actuator member in an actuator member movement towards an end position of the pneumatic actuator, wherein the compressed air supply device is further configured to provide an end position damping for the actuator member movement and, during the end position damping, to adjust a conductance value of a discharge valve, via which the compressed air supply device discharges compressed air from a pressure chamber of the pneumatic actuator which pressure chamber counteracts the actuator member movement, in accordance with a conductance characteristic in dependence of a driving force acting on the actuator member.

12 Claims, 4 Drawing Sheets

SYSTEM AND METHOD FOR END POSITION DAMPING

BACKGROUND OF THE INVENTION

The invention relates to a system comprising a pneumatic actuator having an actuator member. The system further comprises a compressed air supply device configured to supply compressed air to the pneumatic actuator to set the actuator member in an actuator movement towards an end position of the pneumatic actuator. The compressed air supply device is configured to provide end position damping for the actuator member movement.

End position damping is used to reduce the speed at which the actuator member is moved in the end position. The actuator member movement into the end position can also be referred to as end position travel. By means of the end position damping, the actuator member is to be prevented from moving into the end position at too high a speed. In particular, the actuator member should be prevented from colliding unbraked with the end position stop defining the end position. An unbraked or insufficiently braked actuator member movement into the end position can lead to vibrations in the system and can be disruptive or harmful to a process carried out with the system. Furthermore, an unbraked or insufficiently braked actuator member movement can lead to increased wear of the pneumatic actuator and, in extreme cases, to the destruction of the pneumatic actuator or other parts.

In order to have an optimum effect, end position damping must be adapted to the respective application, in particular to the pneumatic actuator and/or a drive object to be driven by means of the actuator member.

Conventionally, end position damping is provided by an end position damping mechanism. The characteristics of such end position damping are mechanically fixed and cannot be adapted, or only to a limited extent.

SUMMARY OF THE INVENTION

It is an object of the invention to provide an end position damping that can be used flexibly.

The object is solved by a system comprising a pneumatic actuator with an actuator member. The system further comprises a compressed air supply device configured to supply compressed air to the pneumatic actuator to set the actuator member in an actuator movement towards an end position of the pneumatic actuator. The compressed air supply device is configured to provide end position damping for the actuator member movement. The compressed air supply device comprises a discharge valve via which the compressed to air supply device discharges compressed air from a pressure chamber of the pneumatic actuator, the pressure chamber counteracting the actuator member movement. The compressed air supply device is configured to set, during the end position damping, a conductance value of the discharge valve according to a conductance value characteristic curve as a function of a driving force acting on the actuator member.

The compressed air supply device thus provides the end position damping by means of a discharge valve and adjusts the conductance value (in German: "Leitwert") of the discharge valve according to a conductance characteristic curve (in German: "Leitwert-Kennlinie") as a function of the driving force. The conductance value of the discharge valve can be used to specifically influence the driving force. This results in a feedback loop in which the conductance value determines the driving force and the conductance value is set on the basis of the driving force. In particular, the compressed air supply device continuously calculates the driving force (for example, based on measured pressure values) and continuously sets the conductance value based on the driving force. At a lower conductance value, the compressed air is released from the pressure chamber more slowly, so that a greater pressure counteracts the actuator member movement and consequently a lower resulting driving force, in particular a negative driving force, is established. The actuator member is decelerated to a greater extent. At a larger conductance value, the compressed air is released from the pressure chamber more quickly, so that a lower pressure counteracts the actuator member movement and a larger resulting driving force is established. The actuator member is slowed down less or is even accelerated. The relationship between the driving force and the conductance value to be set is described by the conductance characteristic curve. The conductance characteristic curve is stored electronically in the compressed air supply device, in particular in a control unit. The conductance characteristic curve can also be referred to as conductance characteristic.

The characteristic of the end position damping is therefore determined by the conductance characteristic curve and not (as in the state of the art) by a structural mechanism. Via the conductance characteristic curve, the end position damping can be adapted to different applications and can therefore be used flexibly.

The conductance value is proportional to the size of a discharge opening provided by the discharge valve, through which discharge opening the compressed air is discharged from the pressure chamber to a compressed air sink, such as the atmosphere. Thus, the adjustment of the conductance value (by the compressed air supply device) corresponds to an adjustment of the discharge opening. The conductance value is the ratio of a volume flow of compressed air flowing through the discharge opening to an input pressure of the discharge valve at supercritical flow (in German: "überkritische Strömung"). The input pressure is the compressed air pressure on the side of the discharge opening facing the pressure chamber.

According to a preferred embodiment, the relationship between the conductance value to be set and the driving force described by the conductance characteristic curve is such that the conductance value to be set increases progressively as the driving force decreases. The conductance value preferably increases quadratically or at least quadratically (with decreasing driving force). Thus, a decreasing driving force of the actuator member is reacted to by a rapidly opening discharge opening of the discharge valve. In this way, excessive braking of the actuator member can be prevented.

The invention further relates to a method for end position damping of an actuator member of a pneumatic actuator, the actuator member performing an actuator member movement towards an end position. The method comprises the steps of: via a discharge valve discharging compressed air from a pressure chamber of the pneumatic actuator, the pressure chamber opposing the actuator member movement and, while releasing the compressed air, adjusting a conductance value of the discharge valve according to a conductance characteristic curve in dependence on a driving force acting on the actuator member.

According to a preferred further embodiment, the method is carried out with the described system or is adapted in correspondence to the system.

BRIEF DESCRIPTION OF THE DRAWINGS

Exemplary details and exemplary embodiments are explained below with reference to the figures. Thereby shows.

DETAILED DESCRIPTION

Figure 1:
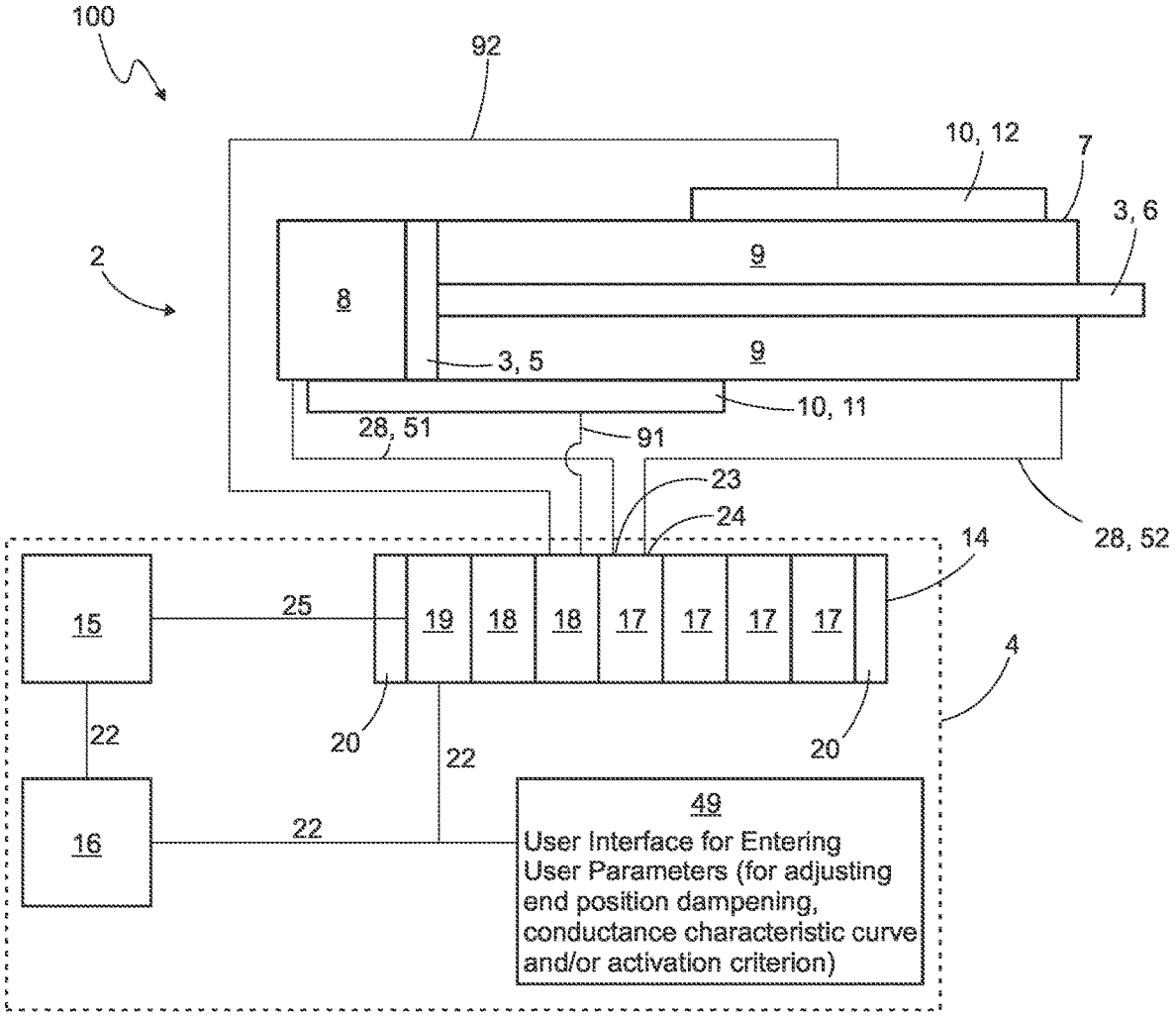
FIG. 1 a schematic view of a system with a compressed air supply device, a hose arrangement and a pneumatic actuator, FIG. 2 a schematic view of a valve device, FIG. 3 a schematic view of the pneumatic actuator, FIG. 4 a diagram of a conductance characteristic curve and FIG. 5 a flow chart of a method.

FIG. 1 shows a system 100 comprising a pneumatic actuator 2, which can be supplied with compressed air, and a compressed air supply device 4. Exemplarily, the system 100 further comprises a hose arrangement 28 connecting the compressed air supply device 4 to the pneumatic actuator 2.

The pneumatic actuator 2 has an actuator member 3. The compressed air supply device 4 is designed to supply compressed air to the actuator 2 via the hose arrangement 28 in order to move the actuator member 3 into a setpoint position, in particular an end position.

The system 100 is suitably used in industrial automation, for example to position a drive object, such as a tool, a workpiece and/or a machine part, via the actuator member 3.

The compressed air supply device 4 comprises the valve arrangement 14, via which the compressed air for positioning the actuator 2 is supplied. Exemplarily, the valve arrangement 14 is designed as a valve island. A valve island may also be referred to as valve terminal. Alternatively, the valve arrangement 14 can also be designed as a single valve or as a different valve device.

Two pressure outputs 23, 24 are provided on the valve arrangement 14 for supplying the compressed air. Each of the two pressure outputs 23, 24 is pneumatically connected to a respective pressure chamber 8, 9 of the pneumatic actuator 2. The valve arrangement 14 can independently aerate and de-aerate the two pressure outputs 23, 24. The valve arrangement 14 comprises a first discharge valve 32 (shown in FIG. 2) to de-aerate the first pressure chamber 8. The first discharge valve 32 is connected between the first pressure output 23 and a compressed air sink, such as the atmosphere. The valve arrangement 14 further comprises a second discharge valve 33 (shown in FIG. 2) to de-aerate the second pressure chamber 9. The second discharge valve 33 is connected between the second pressure output 24 and the compressed air sink, for example the atmosphere.

The valve arrangement 14 has a pressure sensor arrangement 29 (shown in FIG. 2) with pressure sensors with which the pressure at the pressure outputs 23, 24 and/or the pressure in a de-aeration port 26 and/or an aeration port 27 can be measured. These pressure sensors are expediently arranged on the valve arrangement 14, in particular on the valve terminal.

Exemplarily, the valve arrangement 14 comprises a plurality of modules, e.g. valve modules 17 and/or 110 modules 18. The valve arrangement 14 further comprises a control unit 19, which is preferably also designed as a module. The valve arrangement 14 expediently has a carrier body 20, in particular a carrier plate, on which the control unit 19, the valve modules 17 and/or the I/O module 18 are arranged.

The valve arrangement 14 is exemplarily designed as a row module arrangement and can in particular also be referred to as a valve island. The aforementioned modules are in particular row modules, which are preferably plate-shaped. In particular, the valve modules 17 are designed as valve slides. The row modules are expediently arranged in a row next to one another, in particular along the longitudinal axis of the valve arrangement 14.

Exemplarily, the compressed air supply device 4 further comprises a higher-level controller 15 and/or optionally a cloud server 16 and/or a user device (interface) 49, to which a user parameter can be entered for adjusting the end position damping, the conductance characteristic curve and/or an activation criterion.

The valve arrangement 14 is expediently communicatively connected to the higher-level controller 15 and/or the cloud server 16. Preferably, the valve arrangement 14 is connected to the higher-level controller 15 via a bus 25, in particular a local bus, for example a field bus, and/or optionally connected to the cloud server 16 via a wide-area network 22, for example the Internet.

The valve arrangement 14 is communicatively connected to a position sensor device 10 of the actuator 2, in particular via the I/O module 18. Exemplarily, the valve arrangement 14 is communicatively connected to the position sensor device 10 via one or more communication lines 91, 92. Expediently, position values detected by the position sensor device 10 are provided to the control unit 19, the higher-level controller 15 and/or the cloud server 16. Furthermore, expediently, pressure values of the pressure sensors 43, 44, 45, 46 are also provided to the control unit 19, the higher-level controller 15 and/or the cloud server 16.

Exemplarily, the pneumatic actuator 2 is designed as a drive, in particular as a drive cylinder. The pneumatic actuator 2 exemplarily comprises an actuator body 7, the actuator member 3 and two pressure chambers 8, 9. It is expedient that the two pressure chambers 8, 9 can be supplied with compressed air separately from each other. The pneumatic actuator 2 is designed in particular as a double-acting actuator.

The actuator body 7 is preferably designed as a cylinder and has an inner volume. The actuator member 3 comprises, for example, a piston 5 and/or a piston rod 6. The piston 5 is arranged in the actuator body 7 and divides the inner volume of the actuator body 7 into the two pressure chambers 8, 9.

The pneumatic actuator 2 expediently comprises the position sensor device 10. The position sensor device 10 serves in particular to detect a position of the actuator member 3. The position sensor device 10 provides position values that map the position of the actuator member 3. The position sensor device 10 is preferably designed as an analog position transmitter. Exemplarily, the position sensor device 10 is arranged on the outside of the actuator body 7. The position sensor device 10 comprises, for example, two position sensor units 11, 12, which are arranged distributed along the movement path of the actuator member 3. Exemplarily, the position sensor units 11, 12 together cover the entire movement path of the actuator member 3.

Each position sensor unit 11, 12 can, for example, comprise one or more sensor elements (not shown in the figures), in particular magnetic sensor elements, for example Hall sensor elements. Expediently, a magnet is arranged on the actuator member 3, the magnetic field of which can be detected by the magnetic sensor elements.

It is expedient that the position sensor device 10 is designed to detect the position of the actuator member 3 over the entire movement path of the actuator member 3.

On the pneumatic actuator 2 there is expediently no pressure sensor, in particular no pressure sensor for measuring a pressure in one of the pressure chambers 8, 9.

Expediently, the system 100 comprises the hose arrangement 28 via which the compressed air supply device 4, in particular the valve arrangement 14, is pneumatically connected to the pneumatic actuator 2. A first hose 51 pneumatically connects the first pressure output 23 to the first pressure chamber 8, and a second hose 52 pneumatically connects the second pressure output 24 to the second pressure chamber 9.

The higher-level controller 15 is exemplarily designed as a programmable logic controller, PLC, and is communicatively connected to the valve arrangement 14, in particular to the control unit 19. Expediently, the higher-level controller 15 is further connected to the cloud server 16, in particular via a wide-area network 22, preferably via the Internet. The higher-level controller 15 is expediently designed to provide a setpoint signal that specifies a setpoint position, for example an end position, to which the actuator member 3 is to be moved.

The user device 49 is exemplarily a mobile device, for example a smartphone, a tablet computer and/or a notebook. Further, the user device 49 may be a desktop computer, for example a PC. The user device 49 is expediently communicatively connected to the control unit 19, the cloud server 16 and/or the higher-level controller 15, in particular via a wide area network 22, for example the Internet. The user device 49 can expediently be used to access a user interface provided, for example, on the cloud server 16, the controller 15 and/or the control unit 19. The user interface is expediently a web interface. In particular, the user interface is used to select, activate and/or load an application program that provides end position damping to the control unit 19. Furthermore, the user device 49 is expediently designed to operate and/or display the application program that provides the end position damping.

The cloud server 16 is expediently arranged remotely from the valve arrangement 14 and/or the pneumatic actuator 2, in particular at a different geographical location. Preferably, the cloud server 16 is designed to provide an application program with which the end position damping is provided. The application program can be loaded from the cloud server 16 to the higher-level controller 15 and/or the control unit 19, expediently in response to a user input made with the user device 49.

Figure 2:
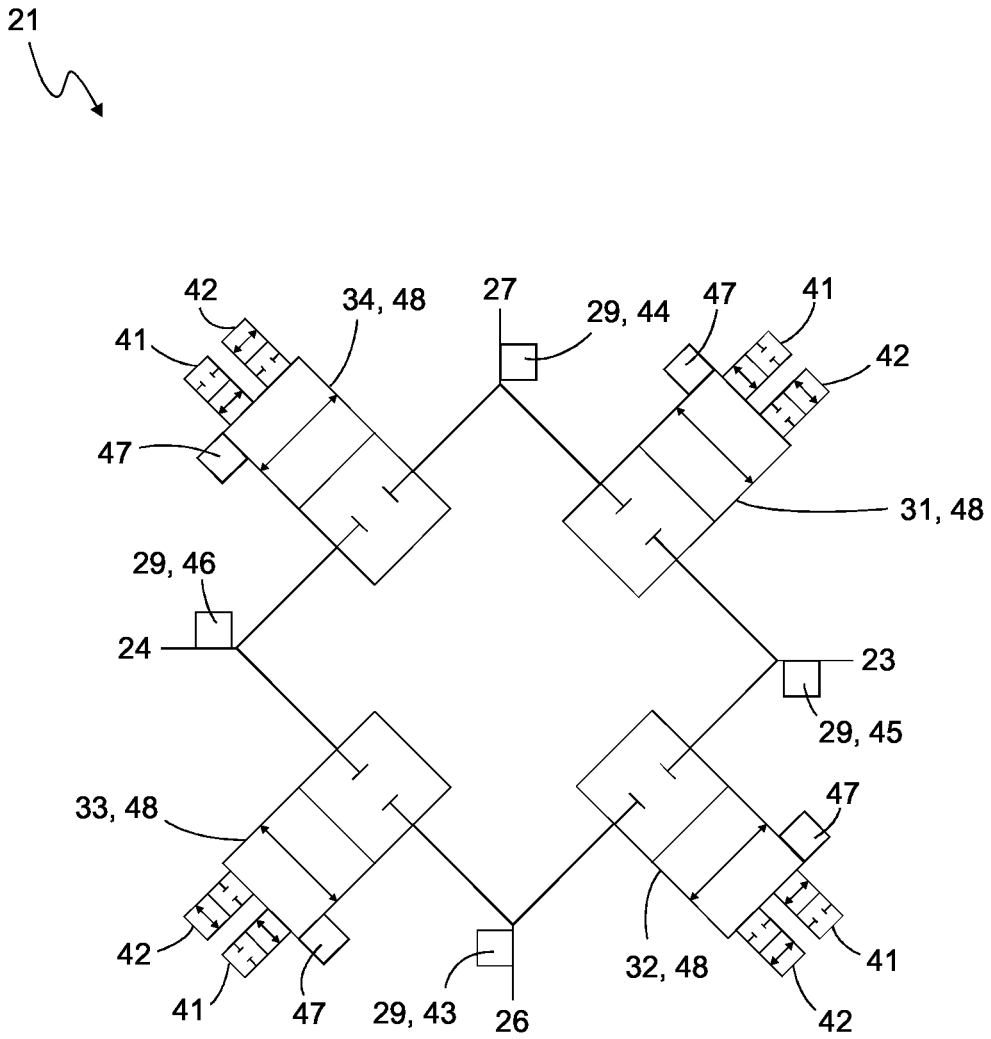

FIG. 2 shows an exemplary valve device 21 with which each of the two pressure chambers 8, 9 can be aerated and de-aerated. The valve device 21 is part of the compressed air supply device 4, in particular of the valve arrangement 14, preferably of a valve module 17.

The valve device 21 has the two pressure outputs 23, 24. The valve device 21 further has a de-aeration port 26 connected to a de-aeration line and an aeration port 27 connected to an aeration line. Expediently, a supply pressure is applied to the aeration port 27. The de-aeration port 26 is connected to a compressed air sink, in particular the atmosphere. Preferably, atmospheric pressure is applied to the de-aeration port 26.

The valve device 21 comprises four valve units, namely a first supply valve 31, a first discharge valve 32, a second discharge valve 33 and a second supply valve 34. Each of the valve units comprises a respective valve member 48. Each of the four valve units is designed as a 2/2-way valve. Exemplarily, each valve unit is configured as a proportional valve; that is, each valve unit has a valve member 48 that can be moved to an open position, a closed position, and any intermediate positions between the open and closed positions. Preferably, the valve units are pilot operated valves, each having two pilot valves 41, 42 through which the valve member 48 can be actuated. The pilot valves 41, 42 are exemplarily designed as piezo valves. The size of a supply opening or discharge opening of the respective valve unit can be expediently set via the position of the respective valve member 48.

The valve device 21 is preferably designed as a full bridge comprising the four valve units. The first supply valve 31 is connected between the aeration port 27 and the first pressure output 23. Via the valve member 48 of the first supply valve 31, the size of a first supply opening through which compressed air is supplied from the aeration port 27 to the first pressure output 23 is adjustable. The first discharge valve 32 is connected between the first pressure output 23 and the de-aeration port 26. Via the valve member 48 of the first discharge valve 32 the size of a first discharge opening is adjustable through which compressed air is discharged from the first pressure output 23 to the de-aeration port 26. The second discharge valve 33 is connected between the de-aeration port 26 and the second pressure output 24. Via the valve member 48 of the second discharge valve 33 the size of a second discharge opening is adjustable through which compressed air is discharged from the second pressure output 24 to the de-aeration port 26. The second supply valve 34 is connected between the second pressure output 24 and the aeration port 27. Via the valve member 48 of the second supply valve 34, the size of a second supply opening is adjustable, via which compressed air is supplied from the aeration port 27 to the second pressure output 24.

The first pressure output 23 can selectively be connected to the de-aeration line via the first discharge valve 32 or to the aeration line via the first supply valve 31, and the second pressure output 24 can selectively be connected to the de-aeration line via the second discharge valve 33 or to the aeration line via the second supply valve 34.

The valve arrangement 14 expediently includes the pressure sensor arrangement 29 having one or more pressure sensors to sense pressures of the valve arrangement 14, in particular the valve device 21.

Exemplarily, the pressure sensor arrangement 29 comprises a first pressure output pressure sensor 45 for sensing the pressure provided at the first pressure output 23 and/or a second pressure output pressure sensor 46 for sensing the pressure provided at the second pressure output 24. Expediently, the pressure sensor arrangement 29 further comprises a supply air pressure sensor 44 for sensing pressure provided at the aeration port 27 and/or an exhaust air pressure sensor 43 for sensing pressure provided at the de-aeration port 26.

The valve arrangement 14, in particular the valve device 21, expediently comprises stroke sensors 47 for detecting the position of the valve members 48. In particular, the compressed air supply device 4 is designed to determine the size of the supply openings and discharge openings by means of the stroke sensors 47.

Figure 3:
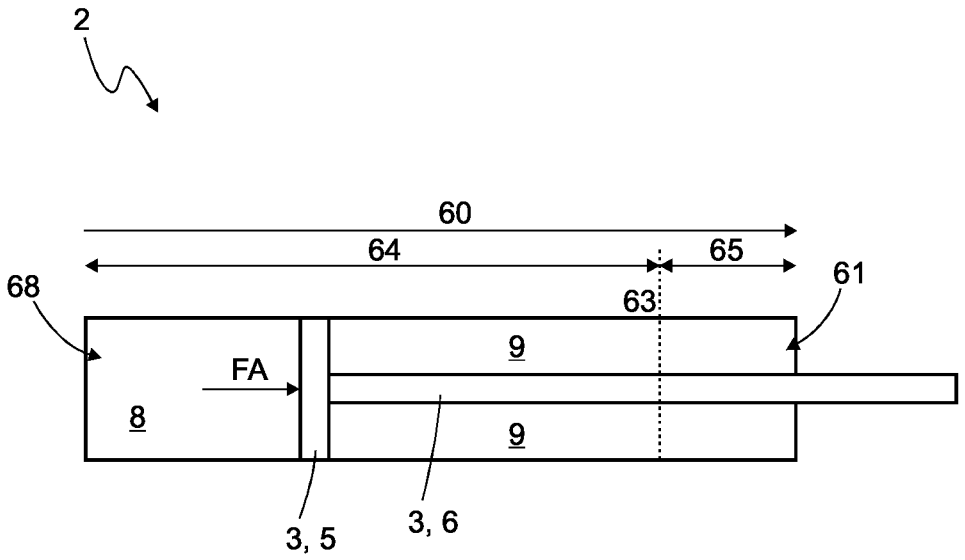

FIG. 3 shows the pneumatic actuator 2 in a state in which the actuator member 3 performs an actuator member movement 60 toward an end position 61 of the pneumatic actuator 2.

The compressed air supply device 4 is designed to supply the pneumatic actuator 2 with compressed air in order to set the actuator member 3 in the actuator member movement 60 towards the end position 61 of the pneumatic actuator 2. For example, the higher-level controller 15 outputs a setpoint signal to the control unit 19, which setpoint signal specifies the end position 61 as the setpoint position for the actuator member 3. In response to the setpoint signal, the control unit 19 controls the valve device 21 to cause the valve device 21 to aerate the first pressure chamber 8 and to de-aerate the second pressure chamber 9 so that the actuator member 3 is set in the actuator member movement 60 toward the end position 61. For example, the control unit 19 provides the valve device 21 with a plurality of conductance values according to which the positions of the valve members 48 are adjusted so that the first pressure chamber 8 is aerated and the second pressure chamber 9 is de-aerated.

The end position 61 shall also be referred to as the first end position 61. The actuator member movement 60 takes place in a first direction of movement. Exemplarily, the actuator member 3, in particular the piston rod 6, is extended from the actuator body 7 during the actuator member movement 60. The end position 61 represents a first end point of the (exemplary linear) movement path of the actuator member 3. In the first end position 61, the actuator member 3 rests against an end position stop which prevents the actuator member 3 from being moved further in the first direction of movement. The end position stop is, for example, an end face of the inner volume of the actuator body 7.

In an exemplary embodiment, the actuator member movement 60 includes a movement phase 64 and a damping phase 65 following the movement phase 64.

The movement phase 64 extends exemplarily over at least 50%, in particular at least 75%, of the movement path. In the movement phase 64, the compressed air supply device 4 expediently does not perform any end position damping of the actuator member 3. The movement phase can, for example, be designed as a throttle travel. The movement path can also be referred to as a stroke. In the movement phase 64, the compressed air supply device 4 aerates the first pressure chamber 8 via the first supply valve 31 and de-aerates the second pressure chamber 9 via the second discharge valve 33. Exemplarily, in the movement phase, the compressed air supply device 4 determines a movement phase driving force FB (shown in FIG. 4) that is required to overcome the forces, for example a frictional force and/or a weight force, that counteract the actuator member movement 60. Expediently, the compressed air supply device 4 determines the conductance value (also referred to as the movement phase conductance value CB) of the second discharge valve 33 required for the movement phase driving force PB. For example, the compressed air supply device 4 determines the movement phase conductance value CB based on the position of the valve member 48 of the second discharge valve detected by the stroke sensor 47.

The movement phase 64 is followed by the damping phase 65. Expediently, the damping phase 65 immediately follows the movement phase 64. In the damping phase 65, the compressed air supply device brakes the actuator member 3 so that the actuator member 3 moves to the end position 61 at a reduced speed.

The compressed air supply device 4 is designed to provide end position damping for the actuator member movement 60 in order to brake the actuator member 3 in the damping phase 65. The compressed air supply device 4 is configured to adjust, during the end position damping, the conductance value C of the second discharge valve 33 according to a conductance characteristic curve 62 in dependence on the driving force FA. The driving force FA acts on the actuator member 3. The compressed air supply device 4 lets compressed air out of the second pressure chamber 9 via the discharge valve 33. The second pressure chamber 9 counteracts the actuator member movement 60.

In particular, the compressed air supply device 4 is designed to provide a closed-loop control of the driving force FA by adjusting the conductance value C. In particular, the compressed air supply device 4 provides a feedback loop. The driving force FA is changed by the adjusted conductance C. Based on the driving force FA, the conductance value C is in turn adjusted. Expediently, the compressed air supply device 4 is designed to continuously calculate the driving force FA in the damping phase and to continuously adjust the conductance value C according to the conductance characteristic curve 62 on the basis of the driving force FA. In particular, the compressed air supply device 4 is designed to provide continuous closed-loop control of the driving force FA in the damping phase on the basis of the conductance characteristic curve 62. Expediently, the closed-loop control of the driving force FA is not based on the position of the actuator member 3. In particular, the closed-loop control of the driving force FA is a non-linear closed-loop control.

Preferably, the compressed air supply device 4 is configured to, during the damping phase 65, close the first pressure chamber 8—i.e., to close the first supply valve 31 and the first discharge valve 32—or to de-aerate the first pressure chamber 8—i.e., to open the first discharge valve 32 and, expediently, to close the first supply valve 31.

Figure 4:
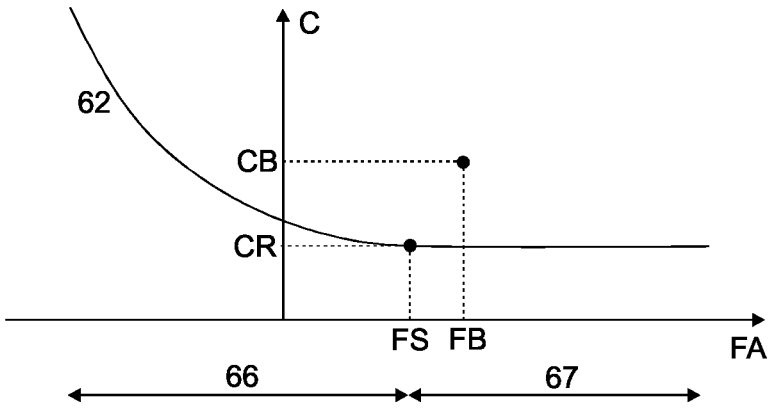

In the following, the conductance characteristic curve 62 shown in FIG. 4 will be discussed in more detail. The driving force FA is plotted on the x-axis and the conductance value C to be set of the second discharge valve 33 is plotted on the y-axis.

The conductance characteristic curve 62 describes a relationship between the conductance value C to be set and the detected driving force FA. For example, the relationship between the conductance value C to be set and the driving force FA is such that the conductance value C to be set increases progressively as the driving force FA decreases. In particular, the relationship between the conductance value C to be set and the driving force FA is such that the conductance value C to be set increases at least quadratically as the driving force FA decreases. The conductance characteristic curve 62 thus expediently comprises a polynomial with a degree greater than or equal to 2. According to a preferred embodiment, the relationship between the conductance value C to be set and the driving force FA is quadratic. As the driving force FA decreases, the conductance value C to be set increases quadratically.

The conductance characteristic curve 62 comprises, by way of example, a progressive section 66. Starting from a positive driving force threshold value FS, the progressive section 66 extends into the region of negative driving force FA—i.e. from the first quadrant into the second quadrant of the diagram shown. The conductance value C of the progressive section 66 increases progressively with decreasing driving force FA, in particular at least quadratically, preferably quadratically. The conductance value C of the progressive section 66 is expediently always positive.

As an example, the conductance characteristic curve 62 further comprises a constant section 67. The constant section 67 extends from the positive driving force threshold FS in the positive direction of the driving force FA. The constant section 67 is located exclusively in the first quadrant. The conductance value C of the constant section 67 is constant. Expediently, the conductance value C of the constant section 67 is equal to a reduced conductance value CR.

Exemplarily, the transition from the progressive section 66 to the constant section 67 is continuous.

The compressed air supply device 4 is expediently adapted to compare the driving force FA with the driving force threshold value FS. In response to the driving force FA being smaller than the driving force threshold value FS, the compressed air supply device 4 adjusts the conductance value C of the second discharge valve 33 according to the conductance characteristic curve 62, in particular according to the progressive section 66. The further the driving force FA drops, the further the discharge opening of the discharge valve 33 is opened, so that a further drop of the driving force FA is prevented or reduced.

In response to the driving force FA being greater than the driving force threshold value FS, the compressed air supply device 4 sets the conductance value C of the second discharge valve 33 to a constant reduced conductance value CR (for example, compared to the movement phase conductance value CB) and/or maintains the conductance value C at the constant reduced conductance CR value (if the conductance value C has already been set to the constant reduced conductance value CR). Exemplarily, the compressed air supply device 4 is configured to set the conductance value C to the constant reduced conductance value CR in accordance with the constant section 67 in response to the driving force FA being greater than the driving force threshold FS.

Thus, provided that the driving force FA is greater than the driving force threshold FS, the conductance value C is reduced to the reduced conductance value CR. This reduction of the conductance value C typically occurs at the transition from the movement phase 64 to the damping phase 65. In the movement phase 64, the conductance value C is equal to the movement phase conductance value CB. Upon entering the damping phase, the compressed air supply device 4 reduces the conductance value C of the second discharge valve 33 from the movement phase conductance value CB to the reduced conductance value CR (provided the driving force FA is greater than the driving force threshold FS). By reducing the conductance value C, the discharge opening of the discharge valve 33 is reduced so that the driving force FA is reduced. In particular, reducing the size of the discharge opening builds up a braking force that opposes the actuator member movement 60. According to a possible embodiment, the discharge opening can be completely closed.

Via the stored conductance characteristic curve, a closed-loop force control of the acting driving force FA may be provided, with the consequence that the actuator member 3 is braked. In addition, it may be achieved that back oscillations of the actuator member 3 are avoided.

Expediently, the compressed air supply device 4 is designed to provide a corresponding end position damping for a second actuator member movement (opposite to the first actuator member movement 60) into a second end position 68. In particular, the compressed air supply device 4 is designed to adjust the conductance value of the first discharge valve 32 in accordance with the conductance characteristic curve 62 during the end position damping of the second actuator member movement.

The following section describes how the end position damping is activated.

According to a preferred embodiment, the compressed air supply device 4 is configured to provide the end position damping in response to a predetermined activation criterion being met. The predetermined activation criterion is, for example, a predetermined position 63 through which the actuator member 3 passes during the actuator member movement 60. In response to the actuator member 3 reaching the predetermined position 63, the compressed air supply device 4 starts the end position damping. The predetermined position 63 thus represents the transition from the movement phase 64 to the damping phase 65. The position of the actuator member 3 is measured, for example, by means of the position sensor device 10 and/or calculated on the basis of detected pressures of the compressed air.

The compressed air supply device 4 may further be configured to use an amount of supplied compressed air as the activation criterion for the end position damping. For example, the compressed air supply device 4 is designed to trigger the end position damping in response to the amount of compressed air supplied to the first pressure chamber 8 exceeding a predetermined threshold value.

The end position damping is expediently adaptable to the system 100, in particular to the pneumatic actuator 2. The compressed air supply device 4 is preferably designed to adapt the end position damping based on at least one system parameter. For example, the at least one system parameter comprises an actuator geometry of the actuator 2 and/or a hose geometry of the hose arrangement 28. For example, the at least one system parameter comprises a cylinder diameter and/or a cylinder length of the pneumatic actuator 2. Furthermore, the at least one system parameter may comprise a mass, in particular a mass moving during the actuator member movement 60. Further, the at least one system parameter may comprise a hose length of the hose arrangement 28. The compressed air supply device 4 is expediently configured to adjust the conductance characteristic curve 62, the reduction factor, and/or the activation criterion based on the system parameter. In particular, the compressed air supply device 4 is configured to adjust parameters of the conductance characteristic curve 62, in particular of the progressive section 66, on the basis of the system parameter.

The system 100 expediently further comprises a user interface through which a user parameter for adjusting the end position damping can be entered. The user interface is provided, for example, by the user device 49. The user parameter is, for example, a tuning parameter. For example, the user parameter describes the conductance characteristic curve 62, the reduction factor, and/or the activation criterion. Further, the user parameter may also be a system parameter mentioned above.

Expediently, the end position damping is provided by means of a program, in particular an application program, which is executed on the control unit 19.

In particular, a calculation of the driving force FA and/or a determination of the conductance value C to be set is carried out by a microcontroller of the control unit 19 on the basis of the conductance characteristic curve 62. The conductance characteristic curve 62 is expediently stored in the control unit 19, in particular the microcontroller of the control unit 19.

Exemplarily, the compressed air supply device 4 is designed to calculate the driving force FA based on detected pressure values of the compressed air. The pressure values are detected by the pressure sensor arrangement 29, for example.

In particular, the compressed air supply device 4 is designed to calculate the driving force FA as the difference between a first pneumatic force FAD acting on the actuator member 3 in the first direction of movement (the direction of movement of the actuator member 60) and a second pneumatic force FLD acting on the actuator member 3 in a second direction of movement (opposite to the first direction of movement). The compressed air supply device 4 is designed in particular to calculate the first pneumatic force FAD and/or the second pneumatic force FLD on the basis of pressure values of the compressed air.

For example, the compressed air supply device 4 is configured to calculate the driving force FA as follows:

$$FA=FAD-FLD$$

FAD is the first pneumatic force acting in the first direction of movement, which first pneumatic force is provided by pressurizing the first pressure chamber 8 with compressed air. For example, FAD is calculated as the product of the pressure p8 of the first pressure chamber 8 and the first effective area A1 of the actuator member 3 on which the pressure p8 acts. FAD is thus obtained as FAD=p8*A1. The pressure p8 is preferably calculated on the basis of a pressure value of the first pressure output 23 detected by the pressure sensor arrangement 29. According to an alternative embodiment (in which a pressure sensor is present at the actuator 2), the pressure p8 can also be measured as a pressure value directly at the actuator 2.

FLD is the second pneumatic force acting in the second direction of movement, which second pneumatic force is provided by pressurizing the second pressure chamber 9 with compressed air and/or by an ambient pressure acting on the actuator member 3, in particular the piston rod 6. Exemplarily, FLD comprises the product of the pressure p9 of the second pressure chamber 9 and the second effective surface A2 of the actuator member 3 on which the pressure p9 acts. Exemplarily, FLD further comprises the product of the ambient pressure pamb, in particular the atmospheric pressure, and a third effective area A3 of the actuator member 3 on which the ambient pressure pamb acts. Exemplarily, the third effective area A3 results as the difference of the first effective area A1 and the second effective area A2. FLD is thus obtained as FLD=p9*A2+pamb*(A1−A2). Preferably, the pressure p9 is calculated based on the pressure value of the second pressure output 24 detected by the pressure sensor arrangement 29. According to an alternative embodiment (in which a pressure sensor is present at the actuator 2), the pressure p9 can also be measured as a pressure value directly at the actuator 2.

The pressures p8 and p9 of the pressure chambers 8, 9 are calculated exemplarily on the basis of the pressure values of the pressure outputs 23, 24 detected with the pressure sensor arrangement 29. The pressure values detected with the pressure sensor arrangement 29 can also be referred to as measurement pressures, and the pressures p8 and p9 calculated on the basis of the measurement pressures can also be referred to as calculation pressures. The calculation pressures are in particular estimated pressures.

The compressed air supply device 4 is thus preferably designed to measure measurement pressures of the compressed air supply device 4 with the pressure sensor arrangement 29 and to calculate calculation pressures on the basis of the measurement pressures, which calculation pressures map the pressures prevailing in the pressure chambers 8, 9 of the pneumatic actuator 2. The compressed air supply device 4 is further configured to calculate the driving force FA based on the calculation pressures.

Preferably, the compressed air supply device 4 is designed to use a hose model of the hose arrangement 28 for calculating the calculation pressures. The hose model represents the influence of the hose on the pressure. The hose model describes the dependence of the respective pressure in the pressure chamber 8, 9 on the respective pressure at the pressure output 23, 24.

Figure 5:
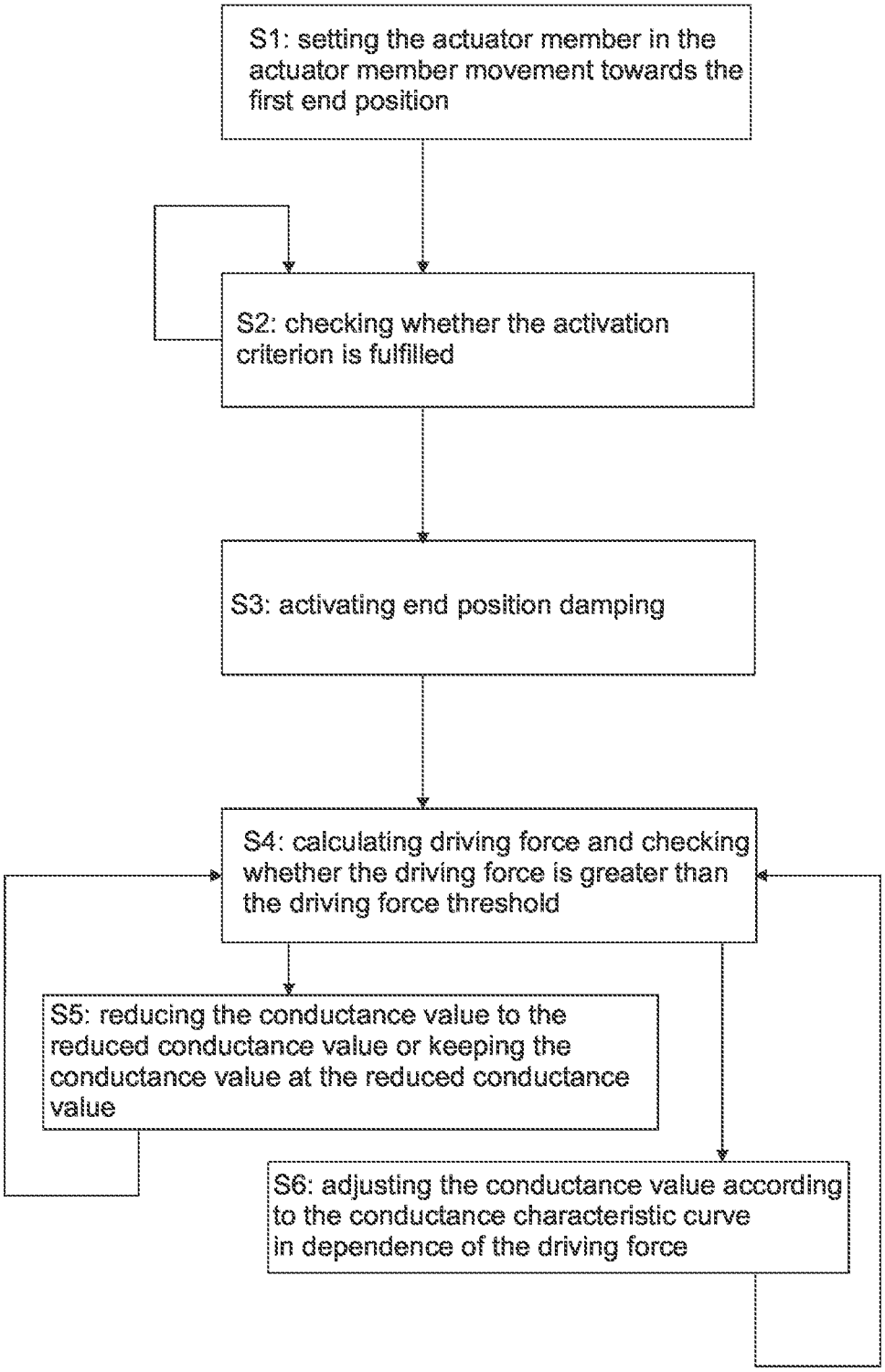

With reference to FIG. 5, a method for end position damping of the actuator member 3 will be described below.

The method comprises a first step S1, in which the actuator member 3 is set in the actuator member movement 60 towards the first end position 61. In step S1, the first pressure chamber 8 is aerated and the second pressure chamber 9 is de-aerated.

The method continues with a step S2, in which it is checked whether the activation criterion is fulfilled. For example, in step S2 it is checked whether the actuator member 3 has reached the predetermined position 63.

In response to the activation criterion being fulfilled, the method continues with step S3. At step S3, the movement phase 64 ends and the damping phase 65 begins. At the step S3, the end position damping of the actuator member 3 is activated. Furthermore, at step S3, expediently, the aeration of the first pressure chamber 8 is terminated. During the damping phase, compressed air is (still) released via the discharge valve 33 from the pressure chamber 9 opposing the actuator member movement 60.

The method continues with step S4, in which the driving force FA is calculated and it is checked whether the driving force FA is greater than the driving force threshold FS.

In response to the driving force FA being greater than the driving force threshold FS, step S5 is executed in which the conductance value C of the discharge valve 33 is reduced to the reduced conductance value CR. Provided that the conductance value C is already equal to the reduced conductance value CR, the conductance value C is kept at the reduced conductance value CR. The method then returns to step S4.

In response to the driving force FA not being greater than the driving force threshold FS, the method proceeds to step S6. At step S6, the conductance value of the discharge valve 33 is adjusted according to the conductance characteristic curve 62, in particular according to the progressive section 66, in dependence of the driving force FA. The method then returns to step S4.

What is claimed is:

1. A system, comprising a pneumatic actuator with an actuator member, and a compressed air supply device, which is configured to apply compressed air to the pneumatic actuator in order to set the actuator member in an actuator member movement towards an end position of the pneumatic actuator, wherein the compressed air supply device is further configured to provide an end position damping for the actuator member movement and, during the end position damping, to discharge, via a discharge valve, compressed air from a pressure chamber of the pneumatic actuator, which pressure chamber counteracts the actuator member movement, and, during the end position damping, to adjust a conductance value of the discharge valve in accordance with a conductance characteristic curve in dependence of a driving force acting on the actuator member, and wherein the compressed air supply device is configured to provide a closed-loop control of the driving force by adjusting the conductance value.

2. The system according to claim 1, wherein the conductance characteristic curve describes a relationship between the conductance value to be set and the driving force, according to which relationship the conductance value to be set increases progressively as the driving force decreases.

3. The system according to claim 1, wherein the compressed air supply device is configured, in response to the driving force being greater than a driving force threshold, to adjust the conductance value to a constant reduced conductance value and/or to maintain it at the constant reduced conductance value.

4. The system according to claim 1, wherein the compressed air supply device is configured to activate the end position damping in response to a predetermined activation criterion being met.

5. The system according to claim 1, wherein the compressed air supply device is configured to activate the end position damping in response to the actuator member reaching a predetermined position.

6. The system according to claim 1, wherein the compressed air supply device is configured to adapt the end position damping on the basis of a system parameter.

7. The system according to claim 6, wherein the system parameter includes an actuator geometry and/or a hose geometry of a hose arrangement connecting the pneumatic actuator to the compressed air supply device.

8. The system according to claim 1, wherein the compressed air supply device is configured to adapt the conductance characteristic curve, and/or an activation criterion on the basis of a system parameter.

9. The system according to claim 8, wherein the system parameter includes an actuator geometry and/or a hose geometry of a hose arrangement connecting the pneumatic actuator to the compressed air supply device.

10. A system, comprising a pneumatic actuator with an actuator member, and a compressed air supply device, which is configured to apply compressed air to the pneumatic actuator in order to set the actuator member in an actuator member movement towards an end position of the pneumatic actuator, wherein the compressed air supply device is further configured to provide an end position damping for the actuator member movement and, during the end position damping, to discharge, via a discharge valve, compressed air from a pressure chamber of the pneumatic actuator, which pressure chamber counteracts the actuator member movement, and, during the end position damping, to adjust a conductance value of the discharge valve in accordance with a conductance characteristic curve in dependence of a driving force acting on the actuator member, and wherein the conductance characteristic curve describes a relationship between the conductance value to be set and the driving force, according to which relationship the conductance value to be set increases at least quadratically as the driving force decreases.

11. A system, comprising a pneumatic actuator with an actuator member, and a compressed air supply device, which is configured to apply compressed air to the pneumatic actuator in order to set the actuator member in an actuator member movement towards an end position of the pneumatic actuator, wherein the compressed air supply device is further configured to provide an end position damping for the actuator member movement and, during the end position damping, to discharge, via a discharge valve, compressed air from a pressure chamber of the pneumatic actuator, which pressure chamber counteracts the actuator member movement, and, during the end position damping, to adjust a conductance value of the discharge valve in accordance with a conductance characteristic curve in dependence of a driving force acting on the actuator member, and further comprising a user interface via which a user parameter for adjusting the end position damping, can be entered.

12. A system, comprising a pneumatic actuator with an actuator member, and a compressed air supply device, which is configured to apply compressed air to the pneumatic actuator in order to set the actuator member in an actuator member movement towards an end position of the pneumatic actuator, wherein the compressed air supply device is further configured to provide an end position damping for the actuator member movement and, during the end position damping, to discharge, via a discharge valve, compressed air from a pressure chamber of the pneumatic actuator, which pressure chamber counteracts the actuator member movement, and, during the end position damping, to adjust a conductance value of the discharge valve in accordance with a conductance characteristic curve in dependence of a driving force acting on the actuator member, and further comprising a user interface via which a user parameter for adjusting the conductance characteristic curve, and/or an activation criterion can be entered.

* * * * *